US011008804B2

(12) United States Patent
Kao

(10) Patent No.: US 11,008,804 B2
(45) Date of Patent: May 18, 2021

(54) CURTAIN CONTROLLER STRUCTURE

(71) Applicant: UNI-SOLEIL ENTERPRISE CO., LTD., Tainan (TW)

(72) Inventor: Yu-Ting Kao, Tainan (TW)

(73) Assignee: Uni-Soleil Enterprise Co., Ltd., Tainan (TW)

( * ) Notice: Subject to any disclaimer, the term of this patent is extended or adjusted under 35 U.S.C. 154(b) by 297 days.

(21) Appl. No.: 16/244,341

(22) Filed: Jan. 10, 2019

(65) Prior Publication Data

US 2019/0211622 A1 Jul. 11, 2019

(30) Foreign Application Priority Data

Jan. 11, 2018 (TW) ..... 107200513

(51) Int. Cl.

| | |
|---|---|
| ***E06B 9/322*** | (2006.01) |
| ***E06B 9/326*** | (2006.01) |
| ***E06B 9/78*** | (2006.01) |
| *E06B 9/42* | (2006.01) |

(52) U.S. Cl.

CPC ..... *E06B 9/322* (2013.01); *E06B 9/326* (2013.01); *E06B 9/78* (2013.01); *E06B 9/42* (2013.01); *E06B 2009/3265* (2013.01); *E06B 2009/785* (2013.01)

(58) Field of Classification Search

CPC . E06B 9/322; E06B 9/326; E06B 9/78; E06B 9/42; E06B 2009/3265; E06B 2009/785

See application file for complete search history.

(56) References Cited

U.S. PATENT DOCUMENTS

| | | | | |
|---|---|---|---|---|
| 8,220,520 | B2 * | 7/2012 | Lukos | E04F 10/0662 160/242 |
| 10,626,670 | B2 * | 4/2020 | Cheng | E06B 9/50 |
| 2004/0226663 | A1 * | 11/2004 | Smith | E06B 9/68 160/84.05 |
| 2012/0017399 | A1 * | 1/2012 | Huang | E06B 9/326 24/115 F |
| 2013/0081496 | A1 * | 4/2013 | Ishikawa | F16H 55/0833 74/412 R |
| 2019/0343318 | A1 * | 11/2019 | Cheng | A47H 5/02 |

FOREIGN PATENT DOCUMENTS

| | | | | |
|---|---|---|---|---|
| DE | 202017103213 U1 * | 6/2017 | | E06B 9/50 |
| GB | 2559796 A * | 8/2018 | | E06B 9/78 |
| TW | 201607478 A | 3/2016 | | |

* cited by examiner

*Primary Examiner* — Johnnie A. Shablack
*Assistant Examiner* — Matthew R. Shepherd
(74) *Attorney, Agent, or Firm* — Rosenberg, Klein & Lee

(57) ABSTRACT

A curtain controller structure includes a fixing seat, an assembling seat having an accommodation space formed between the fixing seat and the assembling seat. The assembling seat includes a first chamber. A bead chain disc is disposed in the accommodation space. A first driving assembly is disposed in the first chamber of the assembling seat and has a first driving unit and a second driving unit. A traction string is connected to the first driving unit or the second driving unit of the first driving assembly and the bead chain disc.

6 Claims, 9 Drawing Sheets

CURTAIN CONTROLLER STRUCTURE

BACKGROUND OF THE INVENTION

1. Field of the Invention

The present invention relates to a curtain controller structure which comprises a bead chain disc to be easily assembled and repositioned if it falls off and a traction string connected to the bead chain disc even if the bead chain disc is detached to unwind a bead chain string on the children's necks.

2. Description of Related Art

Referring to a Taiwan Patent No. TW201607478 (A), the Taiwan Patent published on 1 Mar. 2016, has disclosed a device for rotating the shaft of a roller blind or the like. It mainly comprises a roller for coupling with a shaft and a chain either a cord running over the roller. The side walls of the roller are provided with conical cavities in which support members are accommodated, and at least one of the support members is resilient and pressed against the roller by a spring so that the roller is left in the housing. The housing is fixed on the wall of the building. When a force higher than a given value is exerted, the roller can be drawn out of the housing. Although the aforementioned structure can prevent children's necks from being wrapped around by the cord due to the roller being drawn out of the housing and the cord detaching from the roller for further releasing the cord from the children's necks, it still have many disadvantages in use.

1. The roller of the cord device of the existing curtain controller may fall on the ground after it is detached from the housing, so the roller is easily lost or picked up and mistakenly eaten by children, resulting in the inability to reassemble the roller. In such a case, a new roller is needed to replace as a replacement, and if the production of the curtain controller is discontinued, the user must change the entire set of the curtain controller, which causes economic burdens on users.

2. The housing is thicker than a normal curtain controller due to the support members and the spring being disposed in the housing, so the abovementioned structure occupies much space in use. Furthermore, there will be a considerable gap between the roller blind and the wall of the building due to the large volume of the assembled housing, resulting in the roller blind not correspondingly and completely shielding the windows and lacks aesthetics.

SUMMARY OF THE INVENTION

Therefore, in view of the above-mentioned problems, the aspect of the present invention is to provide a curtain controller structure which comprises a bead chain disc to be easily assembled and repositioned if it falls off and a traction string connected to the bead chain disc even if the bead chain disc is detached to unwind a bead chain string on the children's necks so as to facilitate the assembly of the bead chain disc.

Disclosed herein is a curtain controller structure. It mainly comprises a fixing seat, an assembling seat, a bead chain disc, a first driving assembly, a traction string, and a bushing. The fixing seat has a first end, a second end opposite to the first end, a guiding ring radially descended from a center to a periphery at the second end thereof, and at least one long slot hole having an arc-shape and disposed on one side of the guiding ring for penetrating the first end and the second end thereof. The assembling seat has a first end for connecting the second end of the fixing seat, a second end opposite to the first end, an accommodation space formed between the fixing seat and the assembling seat, a first chamber disposed at the second end thereof, and a first aperture formed on a bottom center of the first chamber for communication with the accommodation space at the first end thereof. The bead chain disc is disposed in the accommodation space and provided with a first end wall toward the fixing seat, a second end wall opposite to the first end wall, and a bead chain winding region formed between an inner surface of the first end wall and an inner surface of the second end wall, a guiding recess radially protruded from a center to a periphery of an outer surface of the first end wall for connecting the guiding ring of the fixing seat for positioning, and a cone-shaped tank on an outer surface of the second end wall. Preferably, the first end wall has a diameter less than a diameter of the second end wall. The first end wall faces the fixing seat, and the second end wall faces the first driving assembly. The first driving assembly has a first driving unit adjacent to the second end wall of the bead chain disc, an elastic unit and a second driving unit, the first driving unit, the elastic unit and the second driving unit are sequentially accommodated in the first chamber. The first driving unit has a first end shaped with a cone and protruded from the first aperture on the first chamber to the accommodation space for correspondingly connecting the cone-shaped tank, and a second end opposite to the first end. The elastic unit has a first end connected to the first driving unit and a second end connected to the second driving unit. The traction string has a first part for connecting a center of the bead chain disc and a second part opposite to the first part for connecting the first driving unit or the second driving unit of the first driving assembly. The bushing is assembled to the second end of the assembling seat to position the first driving assembly in the first chamber of the assembling seat.

According to an embodiment of the present invention, the first driving unit of the first driving assembly has a first stop flange disposed between the first end and the second end thereof and in contact with a bottom of the first chamber for positioning, the first end protruded to the accommodation space for connecting the cone-shaped tank of the bead chain disc, a plurality of second convex ribs spaced apart from one another on a wall of the first end of the first driving unit for correspondingly contacting a plurality of first convex ribs spaced apart from one another on a wall of the cone-shaped tank for positioning, an assembling slot shaped with a polygon and disposed at the second end thereof for accommodating the elastic unit, and a first pore on a bottom of the assembling slot. The elastic unit has the first end for connecting the bottom of the assembling slot of the first driving unit and the second end for connecting one end of the assembling pillar of the second driving unit. The second driving unit has a first end, a second end opposite to the first end, an assembling pillar shaped with a polygon and disposed at the first end thereof for correspondingly inserting into the assembling slot of the first driving unit, a receiving slot disposed at the second end thereof for receiving the second part of the traction string, and a second aperture at a bottom of the receiving slot. Furthermore, a bottom of the cone-shaped tank of the bead chain disc is provided with a perforation. The first part of the traction string inserts into the second aperture at the bottom of the receiving slot of the second driving unit and passes through the first pore in the assembling slot of the first driving unit to further connect the perforation of the bead chain disc. The second part of the traction string is disposed in the receiving slot of the second driving unit for connecting the second driving unit.

According to an embodiment of the present invention, the first part and the second part of the traction string are respectively formed as a retaining ring and a stop block for contacting the bottom of the receiving slot of the second driving unit for positioning. One side of the perforation at the first end wall of the bead chain disc is provided with a hook portion for hooking the retaining ring of the traction string.

According to an embodiment of the present invention, the first driving unit has a first stop flange disposed between the first end and the second end thereof and in contact with a bottom of the first chamber for positioning, the first end protruded to the accommodation space for connecting the cone-shaped tank of the bead chain disc, a plurality of second convex ribs spaced apart from one another on a wall of the first end of the first driving unit for correspondingly contacting a plurality of first convex ribs spaced apart from one another on a wall of the cone-shaped tank for positioning, an assembling slot shaped with a polygon and disposed at the second end thereof for accommodating the elastic unit, and a first pore on a bottom of the assembling slot. The elastic unit has the first end for connecting the bottom of the assembling slot of the first driving unit and the second end for connecting one end of the assembling pillar of the second driving unit. The second driving unit has a first end, a second end opposite to the first end, an assembling pillar shaped with a polygon and disposed at the first end thereof for correspondingly inserting into the assembling slot of the first driving unit, and a receiving slot disposed at the second end thereof. Furthermore, a bottom of the cone-shaped tank of the bead chain disc is provided with a perforation. The second part of the traction string is disposed in the assembling slot of the first driving unit, and the first part of the traction string passes through the first pore in the assembling slot of the first driving unit to further connect the perforation of the bead chain disc.

According to an embodiment of the present invention, the first part and the second part of the traction string are respectively formed as a retaining ring and a stop block for contacting the bottom of assembling slot of the first driving unit for positioning, and one side of the perforation of the bead chain disc is provided with a hook portion for hooking the retaining ring of the traction string.

According to an embodiment of the present invention, the first end wall has a plurality of first gaps spaced apart from one another on a periphery thereof and a plurality of first toothed parts, and each of the plurality of first toothed parts is formed between the two adjacent first gaps. The second end wall has a plurality of second gaps spaced apart from one another on a periphery thereof and staggered with the plurality of first gaps and a plurality of second toothed part, and each of the plurality of second toothed part is formed between the two adjacent second gaps.

According to an embodiment of the present invention, the bushing has a first end connected to the second end of the assembling seat for contacting a second end of a second stop flange disposed between the first end and the second end of the second driving unit for positioning, a second end opposite to the first end, a second chamber formed at a center of the second end thereof for accommodating a second driving assembly, a second through hole disposed at a bottom center of the second chamber for penetrating the first end of the bushing, and a ring gear disposed on a wall at a bottom of the second chamber. The second driving assembly has a sun gear, a plurality of satellite gears and a third driving unit. The sun gear has one end inserted into and protruded out of the second through hole at a bottom center of the second chamber of the bushing for engaging with a third toothed part disposed on a wall of the receiving slot of the second driving unit of the first driving assembly. The plurality of satellite gears are correspondingly engaged with the ring gear on the wall at the bottom of the second chamber of the bushing by outer sides thereof and correspondingly engaged with the sun gear by inner sides thereof, and each of the plurality of satellite gears has an inserting hole at a center thereof. The third driving unit has a first end provided with a plurality of pins spaced apart from one another for inserting into the inserting holes of the plurality of satellite gears and a second end opposite to the first end.

Additionally, another curtain controller structure is also disclosed herein. It mainly comprises a fixing seat, an assembling seat, a bead chain disc, a first driving assembly, a traction string, and a bushing. The fixing seat has a first end, a second end opposite to the first end, a guiding ring radially descended from a center to a periphery at the second end thereof, and at least one long slot hole having an arc-shape and disposed on one side of the guiding ring for penetrating the first end and the second end thereof. The assembling seat has a first end for connecting the second end of the fixing seat, a second end opposite to the first end, an accommodation space formed between the fixing seat and the assembling seat, a first chamber disposed at the second end thereof, and a first aperture formed on a bottom center of the first chamber for communication with the accommodation space at the first end thereof. The bead chain disc is disposed in the accommodation space and provided with a first end wall toward the fixing seat, a second end wall opposite to the first end wall, and a bead chain winding region formed between an inner surface of the first end wall and an inner surface of the second end wall, a guiding recess radially protruded from a center to a periphery of an outer surface of the first end wall for connecting the guiding ring of the fixing seat for positioning, and a cone-shaped tank on an outer surface of the second end wall. Preferably, the second end wall has a diameter less than a diameter of the first end wall. The first end wall faces the fixing seat, and the second end wall faces the first driving assembly. The first driving assembly has a first driving unit adjacent to the second end wall of the bead chain disc, an elastic unit and a second driving unit, the first driving unit, the elastic unit and the second driving unit are sequentially accommodated in the first chamber. The first driving unit has a first end shaped with a cone and protruded from the first aperture on the first chamber to the accommodation space for correspondingly connecting the cone-shaped tank, and a second end opposite to the first end. The elastic unit has a first end connected to the first driving unit and a second end connected to the second driving unit. The traction string has a first part for connecting a center of the bead chain disc and a second part opposite to the first part for connecting the fixing seat. The bushing is assembled to the second end of the assembling seat to position the first driving assembly in the first chamber of the assembling seat.

According to an embodiment of the present invention, the first driving unit of the first driving assembly has a first stop flange disposed between the first end and the second end thereof and in contact with a bottom of the first chamber for positioning, the first end protruded to the accommodation space for connecting the cone-shaped tank of the bead chain disc, a plurality of second convex ribs spaced apart from one another on a wall of the first end of the first driving unit for correspondingly contacting a plurality of first convex ribs spaced apart from one another on a wall of the cone-shaped tank for positioning, and an assembling slot shaped with a polygon and disposed at the second end thereof for accommodating the elastic unit. The elastic unit has the first end for connecting the bottom of the assembling slot of the first driving unit and the second end for connecting one end of the assembling pillar of the second driving unit. The second driving unit has a first end, a second end opposite to the first end, and an assembling pillar shaped with a polygon and disposed at the first end thereof for correspondingly inserting into the assembling slot of the first driving unit. Preferably, the fixing seat has a first through hole at the center thereof for penetrating the first end and the second end thereof. The traction string has the first part having a retaining ring inserted into the accommodation space for being hooked by a hook portion at the center of the bead chain disc and the second part having a stop block for contacting the first end of the fixing seat for positioning.

Therefore, when the bead chain string wraps on a child's neck and the bead chain disc separates from the accommodation space due to a pulling force applied on the bead chain string for unwinding the bead chain string, the bead chain disc which is pulled out of the accommodation space can be dragged by the traction string to maintain a hanging state outside the accommodation space. As a result, the bead chain disc does not fall onto the ground and disappear, and the bead chain disc can be reassembled on an original position, which decrease economic burdens on users.

DETAILED DESCRIPTION OF THE PREFERRED EMBODIMENT

Hereinafter, an exemplary embodiment of the present invention will be described in detail with reference to the accompanying drawings.

Figure 1:
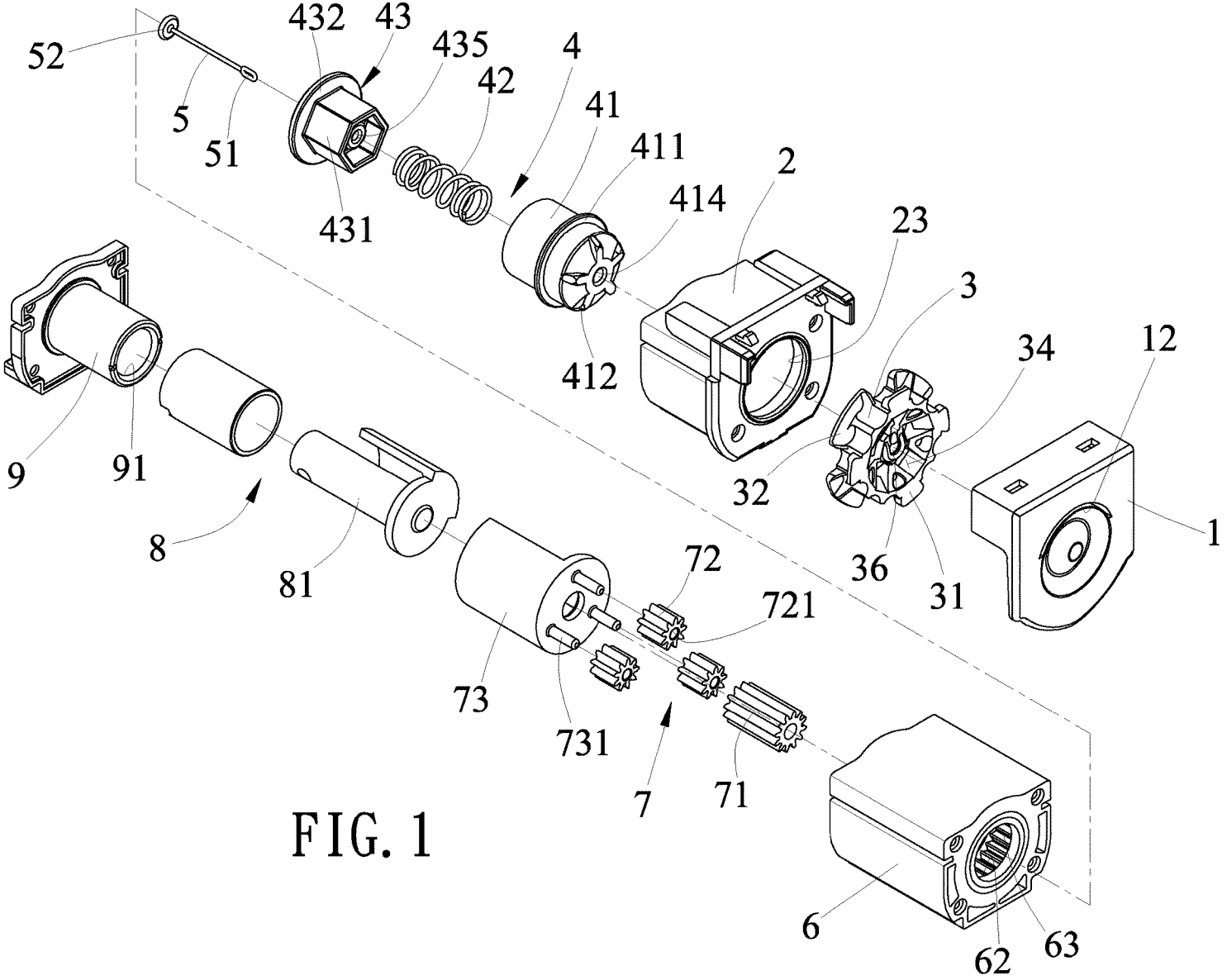
FIG. 1 is a first explosion diagram showing a first embodiment for a curtain controller structure according to the present invention.
Figure 2:
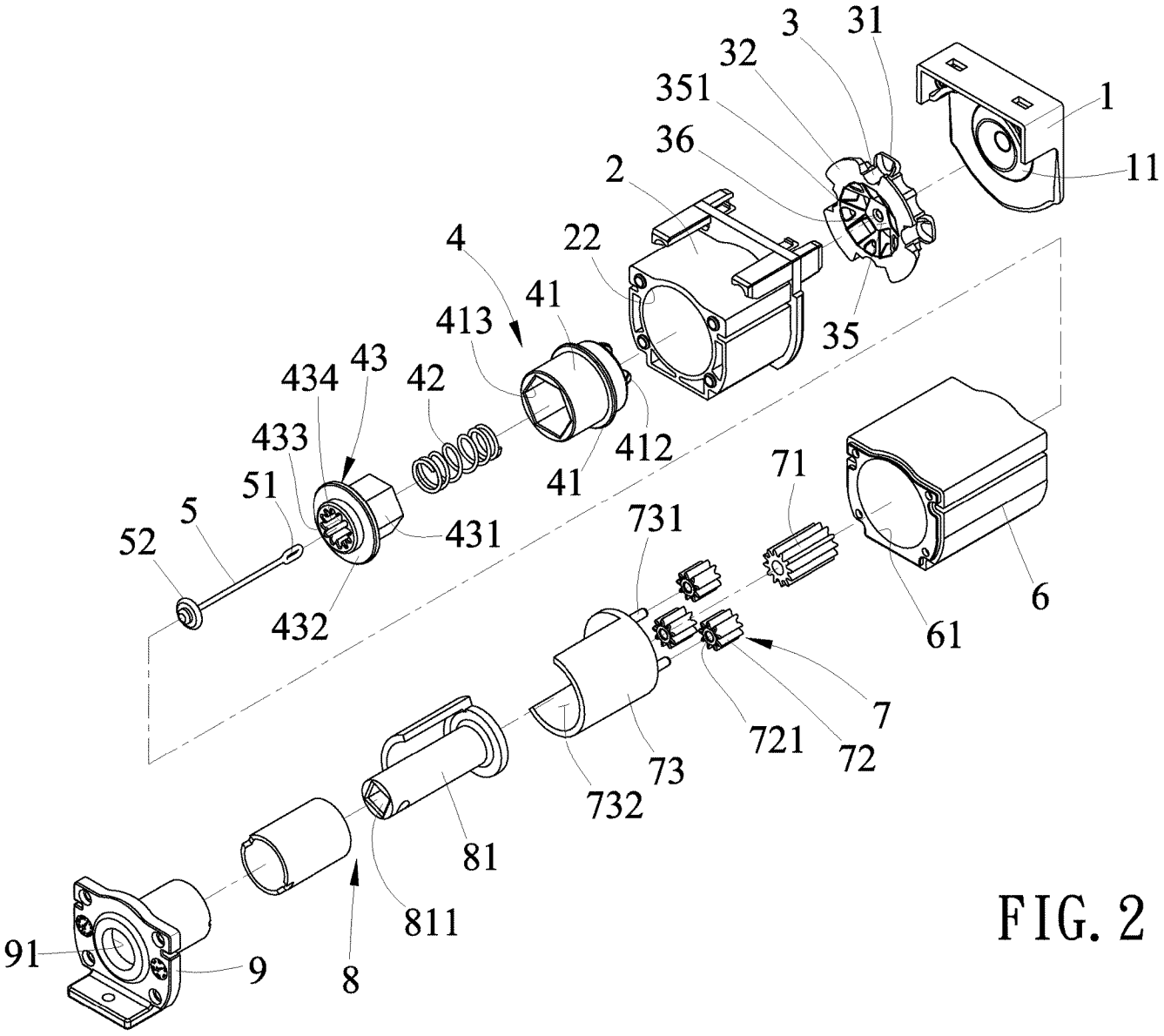
FIG. 2 is a second explosion diagram showing the first embodiment for the a curtain controller structure according to the present invention.
Figure 3:
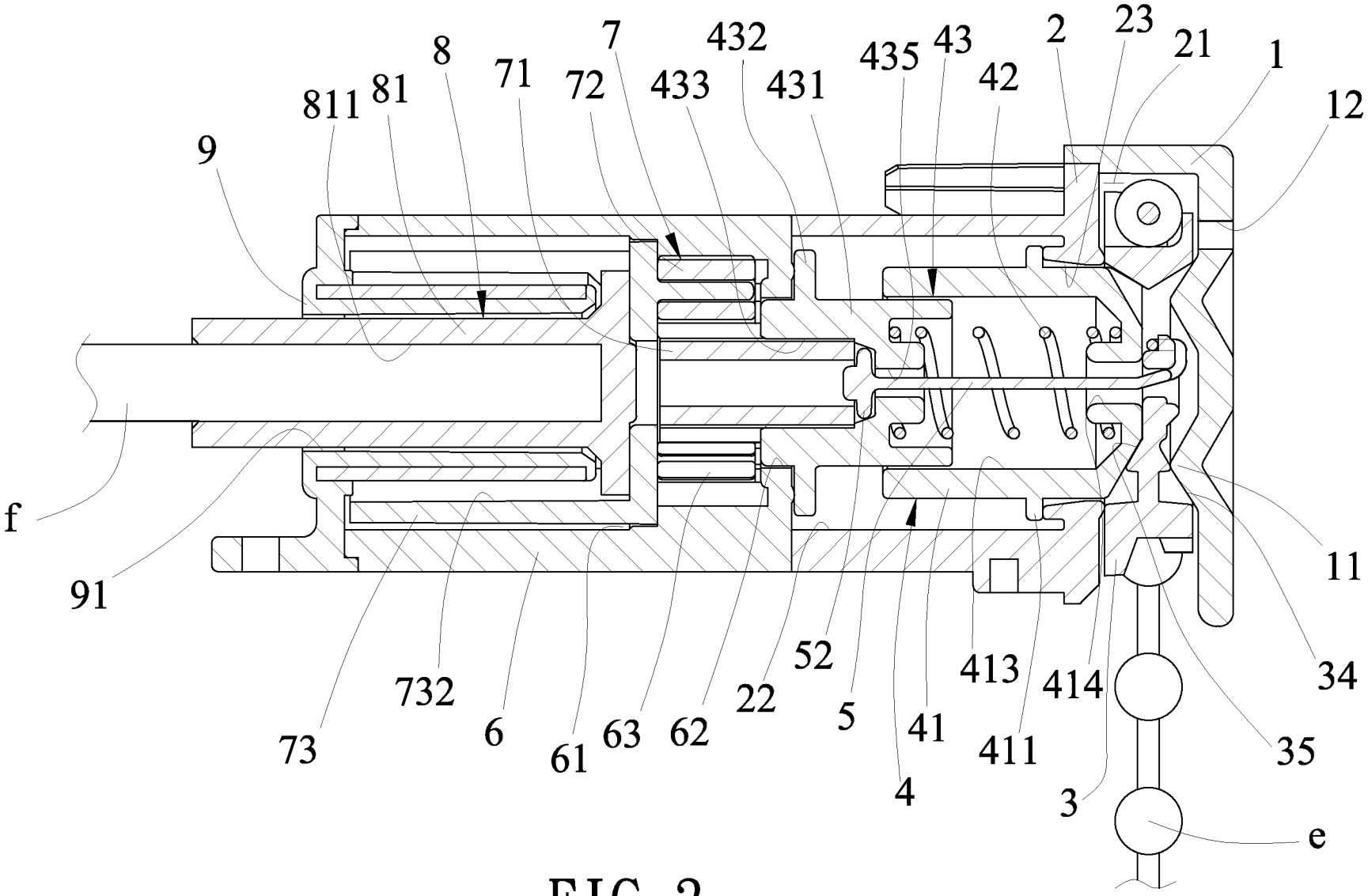
FIG. 3 is a cross-sectional view showing the first embodiment for the curtain controller structure according to the present invention.

Referring to FIG. 1 to FIG. 3, a first embodiment for a curtain controller structure is disclosed herein. It mainly comprises a fixing seat (1), an assembling seat (2), a bead chain disc (3), a first driving assembly (4), a traction string (5), a bushing (6), a second driving assembly (7), a third driving assembly (8), and a lid (9).

The fixing seat (1) has a first end, a second end opposite to the first end, a guiding ring (11) radially descended from a center to a periphery at the second end thereof, and at least one long slot hole (12) having an arc-shape and disposed on one side of the guiding ring (11) for penetrating the first end and the second end thereof.

The assembling seat (2) has a first end for connecting the second end of the fixing seat (1), a second end opposite to the first end, an accommodation space (21) formed between the fixing seat (1) and the assembling seat (2), a first chamber (22) disposed at the second end thereof, and a first aperture (23) formed on a bottom center of the first chamber (22) for communication with the accommodation space (21) at the first end thereof.

Figure 4:
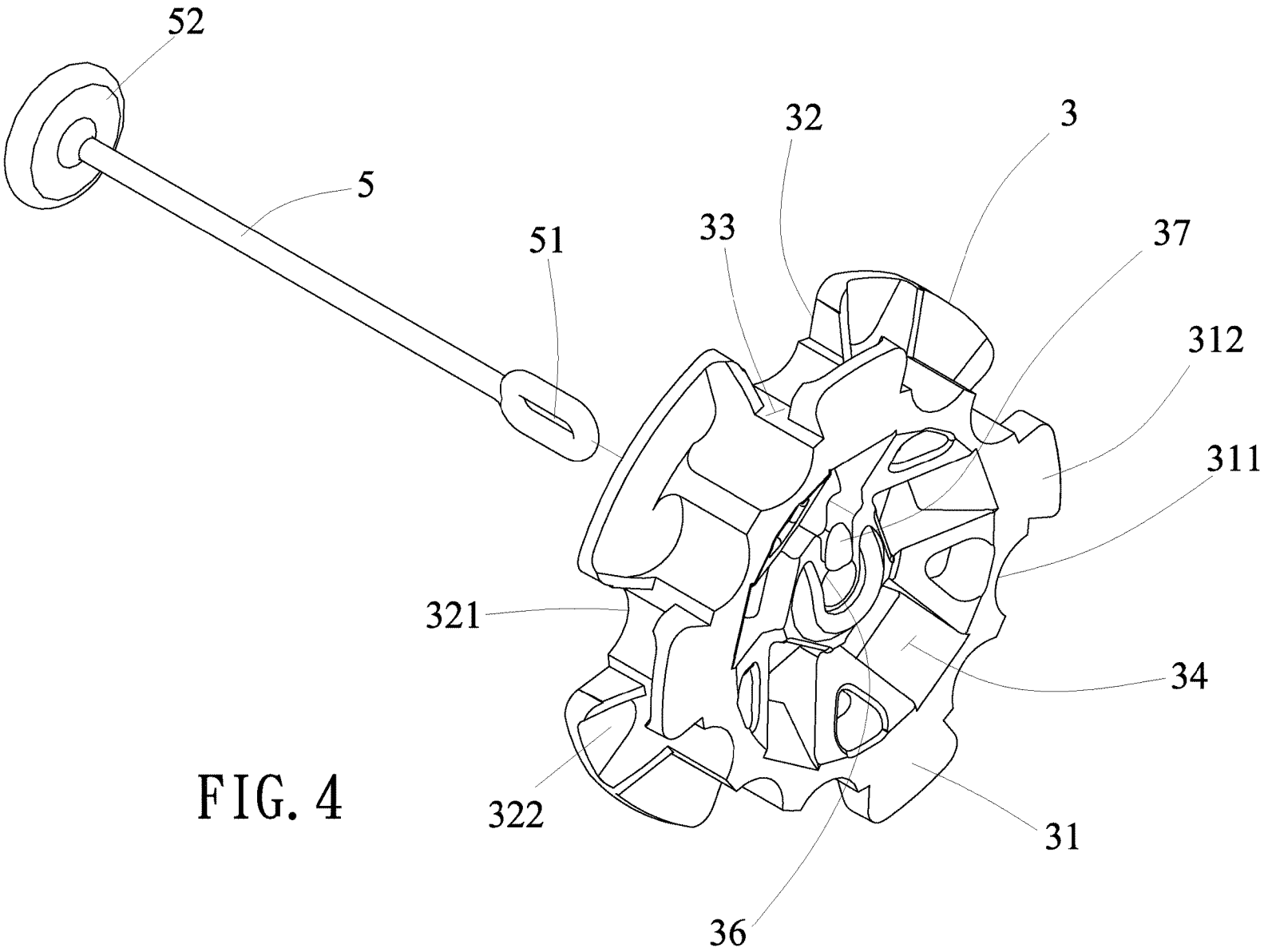
FIG. 4 is a partial enlarged view showing a bead chain disc connected to a traction string according to the present invention.

As shown in FIG. 4, the bead chain disc (3) is disposed in the accommodation space (21) between the fixing seat (1) and the assembling seat (2) and provided with a first end wall (31), a second end wall (32) opposite to the first end wall (31), and a bead chain winding region (33) formed between an inner surface of the first end wall (31) and an inner surface of the second end wall (32), a guiding recess (34) radially protruded from a center to a periphery of an outer surface of the first end wall (31) for connecting the guiding ring (11) of the fixing seat (1) for positioning, and a cone-shaped tank (35) on an outer surface of the second end wall (32). Preferably, the first end wall (31) has a diameter less than a diameter of the second end wall (32). Furthermore, the first end wall (31) has a plurality of first gaps (311) spaced apart from one another on a periphery thereof and a plurality of first toothed parts (312), and each of the plurality of first toothed parts (312) is formed between the two adjacent first gaps (311). The second end wall (32) has a plurality of second gaps (321) spaced apart from one another on a periphery thereof and staggered with the plurality of first gaps (311) and a plurality of second toothed part (322), and each of the plurality of second toothed part (322) is formed between the two adjacent second gaps (321). The cone-shaped tank (35) has a plurality of first convex ribs (351) spaced apart from one another on a wall thereof, and a bottom of the cone-shaped tank (35) of the bead chain disc (3) is provided with a perforation (36) for communication with a center of the guiding recess (34). One side of the perforation (36) at the first end wall (31) of the bead chain disc (3) is provided with a hook portion (37).

The first driving assembly (4) is accommodated in the first chamber (22) and has a first driving unit (41), an elastic unit (42) and a second driving unit (43). The first driving unit (41) has a first end shaped with a cone and protruded from the first aperture (23) on the first chamber (22) for correspondingly connecting the cone-shaped tank (35) of the bead chain disc (3), a second end opposite to the first end, a first stop flange (411) disposed between the first end and the second end thereof and in contact with a bottom of the first chamber (22) for positioning, a plurality of second convex ribs (412) spaced apart from one another on a wall of the first end thereof for correspondingly contacting a plurality of first convex ribs (351) spaced apart from one another on a wall of the cone-shaped tank (35) for positioning, an assembling slot (413) shaped with a polygon (e.g. a hexagon) and disposed at the second end thereof for accommodating the elastic unit (42), and a first pore (414) on a bottom of the assembling slot (413). The elastic unit (42) (e.g. a compression spring) has the first end for connecting the bottom of the assembling slot (413) and the second end for connecting one end of an assembling pillar (431). The second driving unit (43) has a first end, a second end opposite to the first end, the assembling pillar (431) shaped with a polygon (e.g. a hexagon) and disposed at the first end thereof for correspondingly inserting into the assembling slot (413) of the first driving unit (41), a second stop flange (432) disposed between the first end and the second end of the second driving unit (43), a receiving slot (433) disposed at the second end thereof, a third toothed part (434) disposed on a wall of the receiving slot (433), and a second aperture (435) at a bottom of the receiving slot (433). The second stop flange (432) has a first end and a second end opposite the first end. A space is between the first end of the second stop flange (432) of the second driving unit (43) and the second end of the first driving unit (41).

The traction string (5) (e.g. an elastic string) has a first part and a second part opposite to the first part. The first part and the second part of the traction string (5) are respectively formed as a retaining ring (51) and a stop block (52) for contacting the bottom of the receiving slot (433) of the second driving unit (43) for positioning. The first part of the traction string (5) passes from the second aperture (435) of the second driving unit (43) through the first pore (414) on the bottom of the assembling slot (413) of the first driving unit (41) to contact the perforation (36) of the bead chain disc (3). The retaining ring (51) of the traction string (5) is hooked by the hook portion (37). In order to match up the pulling direction of the traction string (5), the first end wall (31) having a diameter less than that of the second end wall (32) faces the fixing seat (1), and the second end wall (32) faces the first driving assembly (4).

The bushing (6) is assembled to the second end of the assembling seat (2) and provided with a first end for contacting a second end of a second stop flange (432) of the second driving unit (43) for positioning, a second end opposite to the first end, a second chamber (61) formed at a center of the second end thereof, a second through hole (62) disposed at a bottom center of the second chamber (61) for penetrating the first end of the bushing (6), and a ring gear (63) disposed on a wall at a bottom of the second chamber (61).

The second driving assembly (7) is accommodated in the second chamber (61) of the bushing (6). Furthermore, the second driving assembly (7) comprises a sun gear (71), a plurality of satellite gears (72) and a third driving unit (73). The sun gear (71) has one end inserted into and protruded out of the second through hole (62) at a bottom center of the second chamber (61) of the bushing (6) for engaging with a third toothed part (434) disposed on a wall of the receiving slot (433) of the second driving unit (43). The plurality of satellite gears (72) are correspondingly engaged with the sun gear (71) by inner sides thereof and correspondingly engaged with the ring gear (63) of the bushing (6) by outer sides thereof, and each of the plurality of satellite gears (72) has an inserting hole (721) at a center thereof. The third driving unit (73) has a first end and a second end opposite to the first end. The first end of the third driving unit (73) is provided with a plurality of pins (731) spaced apart from one another for inserting into the inserting holes (721) of the plurality of satellite gears (72) and a third chamber (732). Additionally, the plurality of satellite gears (72) disposed at the first end of the third driving unit (73) is accommodated in the second chamber (61) of the bushing (6).

The third driving assembly (8) is accommodated in the third chamber (732) of the third driving unit (73) for connecting the third driving unit (73) and further provided with a fourth driving unit (81). The fourth driving unit (81) has a shaft hole (811) shaped with a polygon, e.g. a rectangle, at a center thereof.

The lid (9) connects the second end of the bushing (6) and has a second pore (91) at a center thereof. The fourth driving unit (81) is inserted into and protruded out of the second pore (91) of the lid (9).

Accordingly, in order to prevent children's neck from being wrapped around by a bead chain string (e), a user can choose the first embodiment of the curtain controller structure of the present invention.

In a practical use, the bead chain string (e) wrapped up on the bead chain winding region (33) of the bead chain disc (3) can drive the bead chain disc (3) to rotate, and the bead chain disc (3) further drives the first driving unit (41) to rotate synchronously by the first convex ribs (351) of the cone-shaped tank (35) contacting and pushing the second convex ribs (412) of the first driving unit (41). The rotation of the first driving unit (41) drives the second driving unit (43) to rotate by the polygonal assembling pillar (431) of the second driving unit (43) inserting into the assembling slot (413) so that the second driving unit (43) synchronously drives rotation of the sun gear (71) engaged with the third toothed part (434) in the receiving slot (433), and the sun gear (71) synchronously drives rotation of the plurality of satellite gears (72). The plurality of satellite gears (72) engaged with and guided by the ring gear (63) also drives the third driving unit (73) to rotate at a variable speed. Meanwhile, the fourth driving unit (81) of the third driving assembly (8) connected to the third driving unit (73) also rotate at a variable speed so that a driving shaft (f) having one end inserted into the polygonal shaft hole (811) of the fourth driving unit (81) can drive a curtain of a roller rod connected at its another end to vertically or horizontally shrink or extend.

Figure 5:
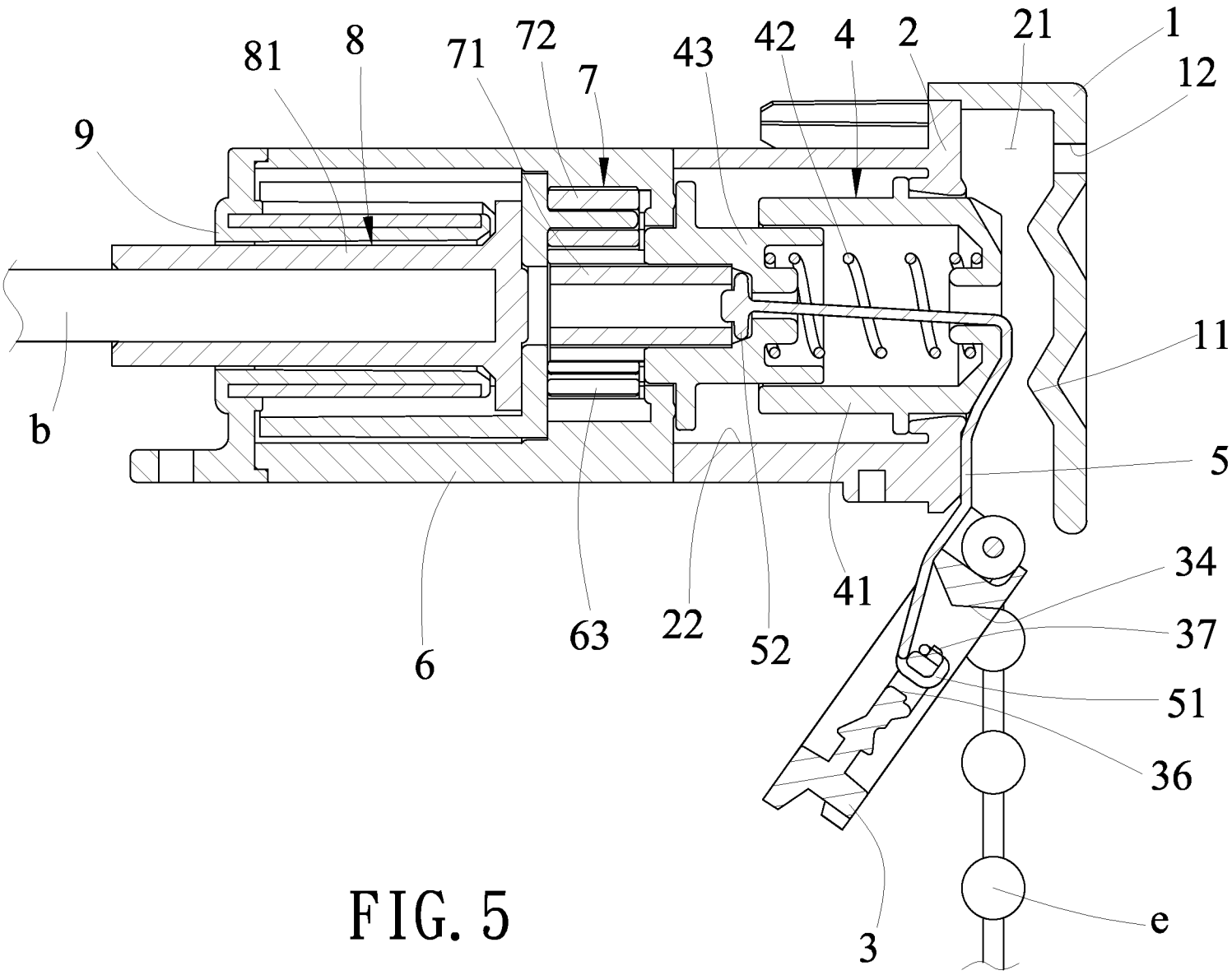
FIG. 5 is a first cross-sectional view showing the first embodiment for the curtain controller structure in use according to the present invention.

Referring to FIG. 5, if a child is accidentally wrapped around their necks by the bead chain string (e) when playing the bead chain string (e) and exerts a pulling force on the bead chain string (e), the cone-shaped first end of the first driving unit (41) can be detached from the cone-shaped tank (35) of the bead chain disc (3) by a slope guidance of the cone-shaped first end of the first driving unit (41) and the cone-shaped tank (35) of the bead chain disc (3) and by a push guidance of the guiding recess (34) and the guiding ring (11) of the fixing seat (1) to push the first driving unit (41) for further compressing the adjacent elastic unit (42) and making the first driving unit (41) move towards the second driving unit (43). Furthermore, the design of the at least one long slot hole (12) disposed at an upper edge of the guiding ring (11) of the fixing seat (1) allows the guiding ring (11) of the fixing seat (1) to be elastically deformed so that the guiding recess (34) of the bead chain disc (3) can be slipped off the guiding ring (11) of the fixing seat (1).

When the bead chain disc (3) is completely disengaged from the bead chain disc (3) and the first driving unit (41) and pulled out of the accommodation space (21), the traction string (5) subjected to the pulling force, and the bead chain disc (3) is inclined toward the first end wall (31) having a less diameter, so that the first end wall (31) of the bead chain disc (3) is first detached from the accommodation space (21). At the same time, the bead chain string (e) on the bead chain winding region (33) can be separated from the plurality of first gaps (311) of the first end wall (31) to unwind the bead chain string (e) on the children's necks, which prevents children from chocking. Then, the second end wall (32) of the bead chain disc (3) is pulled out of the accommodation space (21).

Figure 6:
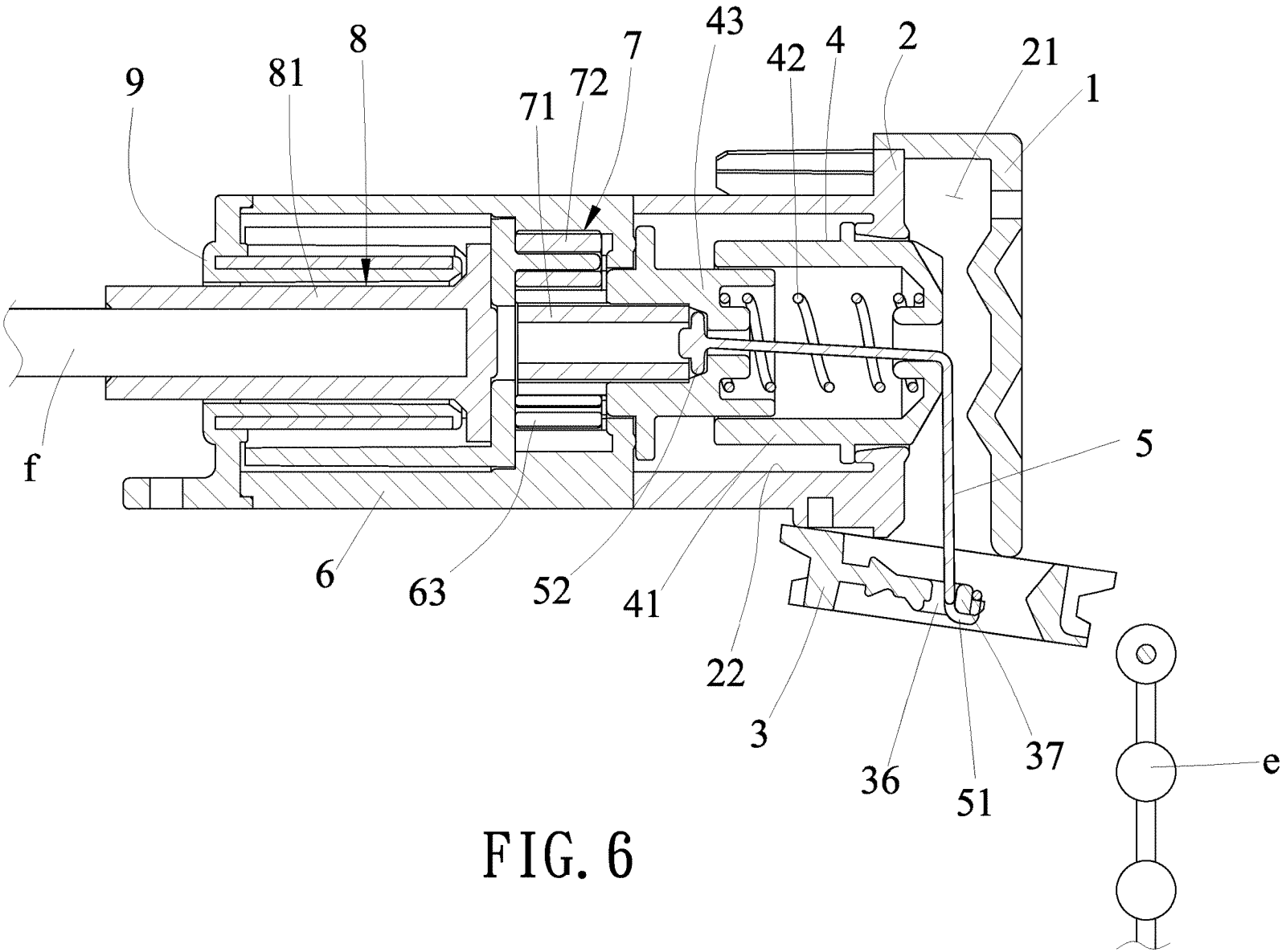
FIG. 6 is a second cross-sectional view showing the first embodiment for the curtain controller structure in use according to the present invention.

Referring to FIG. 6, if the whole bead chain disc (3) is pulled out of the accommodation space (21), the traction string (5) having the first part connected to the second driving unit (43) and the second part connected to the bead chain disc (3) allows the bead chain disc (3) to be dragged by the traction string (5) to maintain a hanging state outside the accommodation space (21) without directly falling onto the ground. Therefore, the bead chain disc (3) will not fall on the ground and disappear, which can prevent children from picking up and mistakenly eating the bead chain disc (3), ensure the bead chain disc (3) to be reassembled on an original position, and decrease economic burdens on users.

Figure 7:
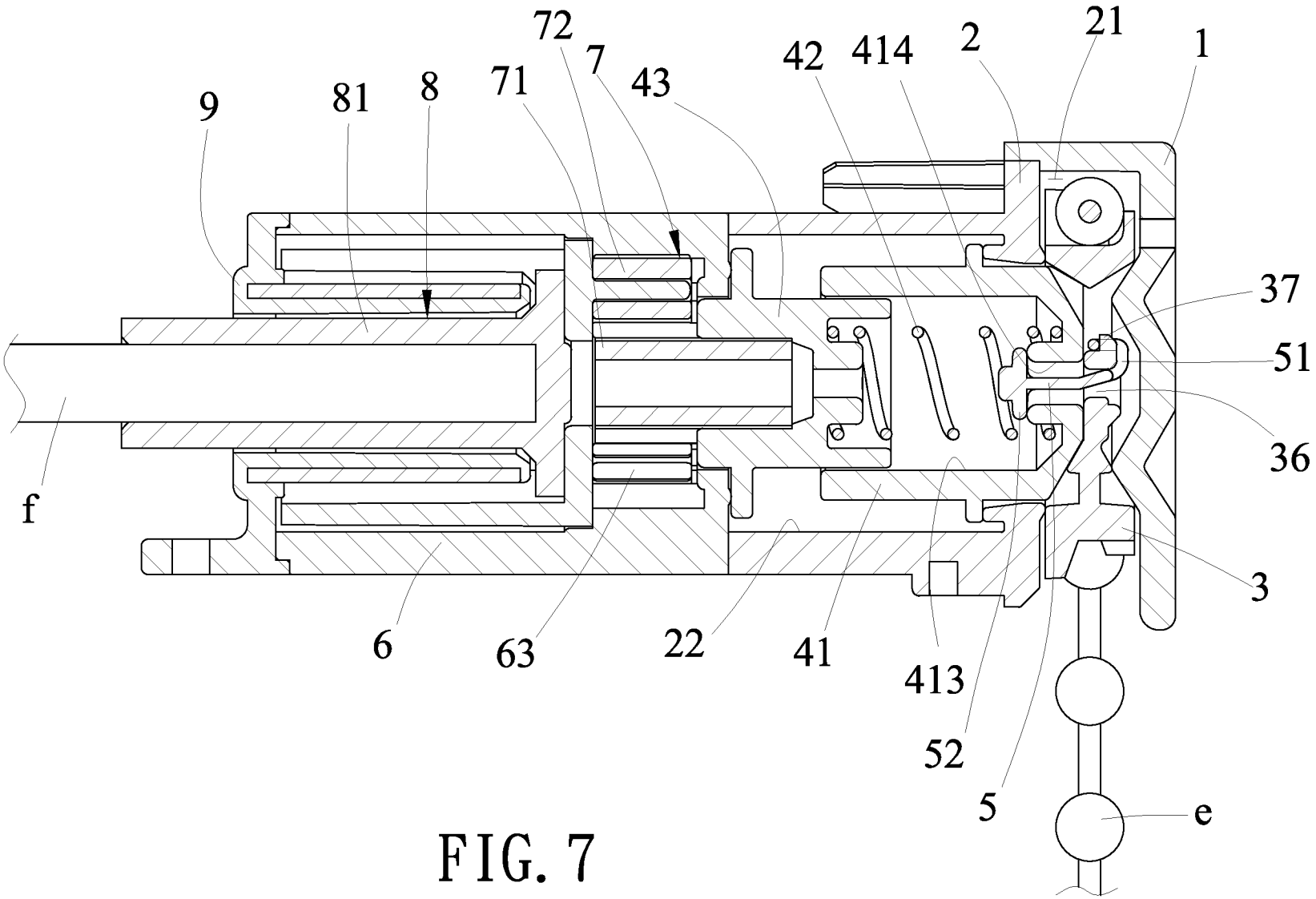
FIG. 7 is a cross-sectional view showing a second embodiment for a curtain controller structure according to the present invention.

Referring to FIG. 7, a second embodiment for a curtain controller structure according to the present invention has the stop block (52) on the second part of the traction string (5) for contacting the assembling slot (413) of the first driving unit (41) for positioning. The first part of the traction string (5) passes through the first pore (414) at the bottom of the assembling slot (413) of the first driving unit (41) and further contacts the perforation (36) of the bead chain disc (3) so as to connect the traction string (5) to the bead chain disc (3) by the hook portion (37) of the bead chain disc (3) hooking the retaining ring (51) of the traction string (5). Accordingly, the design of the traction string (5) having the first part connected to the first driving unit (41) and the second part connected to the bead chain disc (3) allows the bead chain disc (3) to be dragged by the traction string (5) to maintain a hanging state outside the accommodation space (21).

Figure 8:
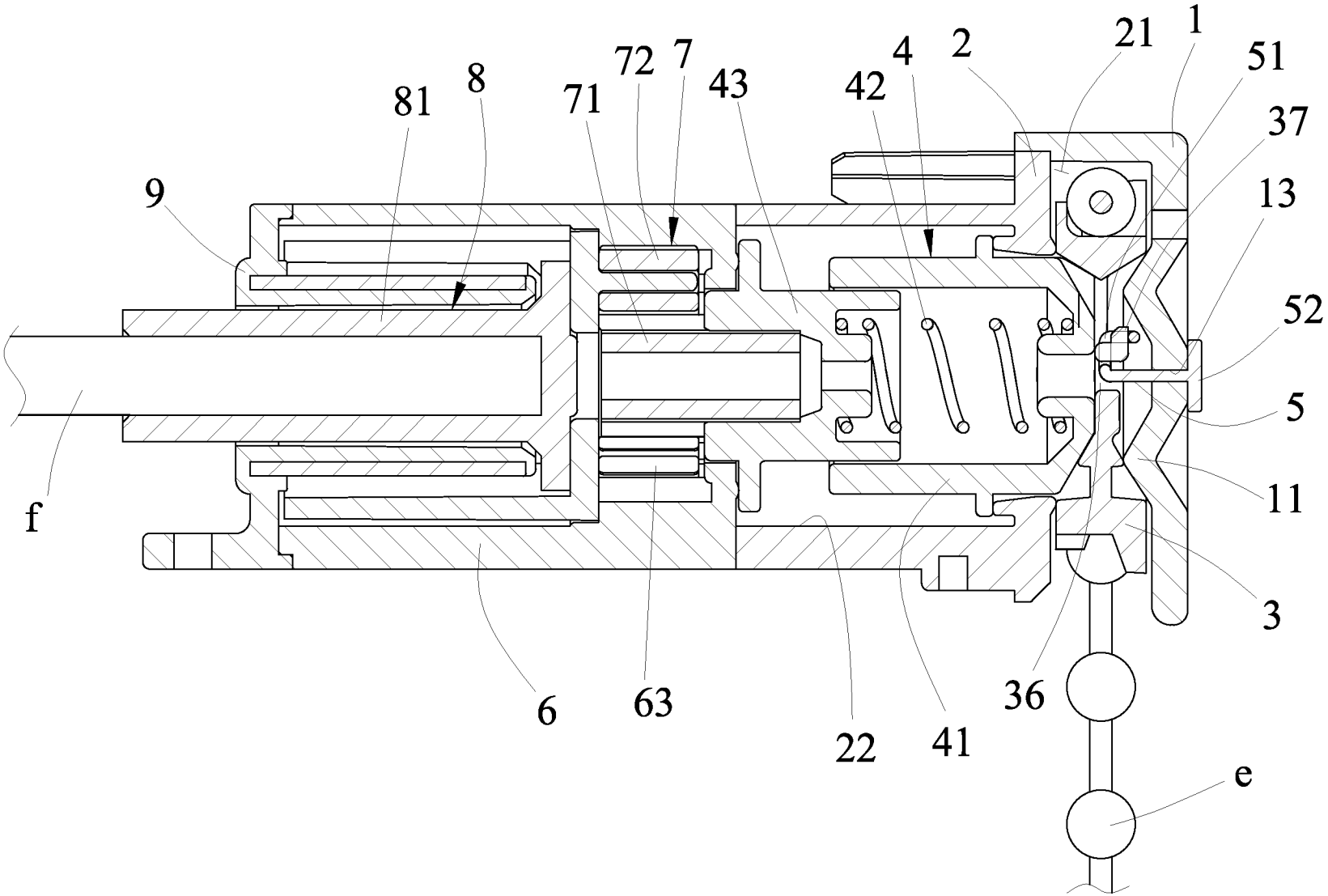
FIG. 8 is a cross-sectional view showing a third embodiment for a curtain controller structure according to the present invention.
Figure 9:
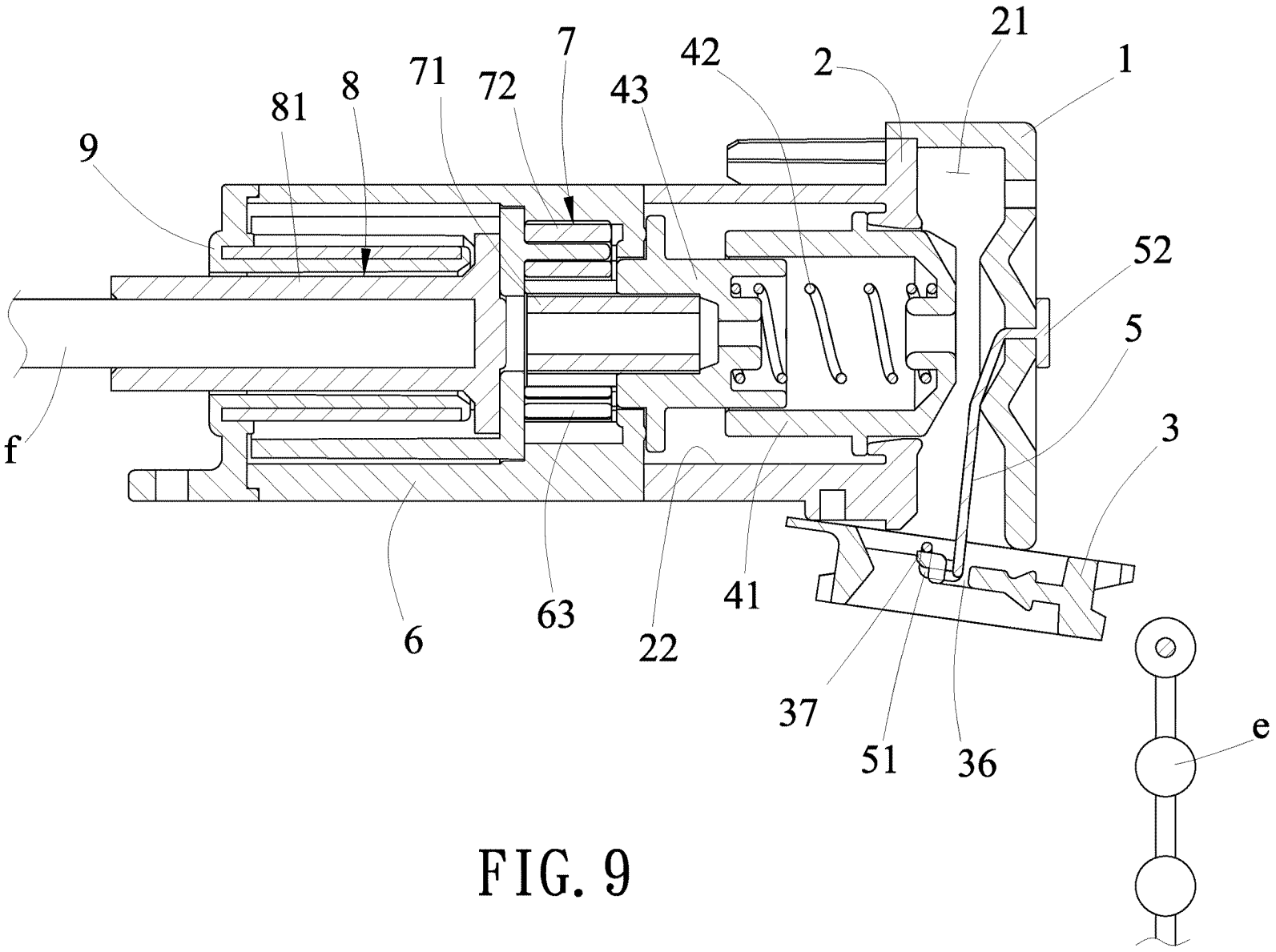
FIG. 9 is a cross-sectional view showing the third embodiment for the curtain controller structure in use according to the present invention.

Referring to FIG. 8 and FIG. 9, a third embodiment for a curtain controller structure in use according to the present invention is disclosed. The third embodiment for the curtain controller structure has a first through hole (13) at a center of the guiding ring (11) at the second end of the fixing seat (1) and the stop block (52) of the traction string (5) to contact the first end of the fixing seat (1) for positioning. The first part of the traction string (5) penetrates the first through hole (13) of the fixing seat (1), passes through the perforation (36) on the guiding recess (34) of the bead chain disc (3), and finally contacts the cone-shaped tank (35). Moreover, the hook portion (37) of the bead chain disc (3) hooks the retaining ring (51) of the traction string (5), so that the first part and the second part of the traction string (5) respectively connects the fixing seat (1) and the bead chain disc (3). In order to match up the pulling direction of the traction string (5), the second end wall (32) having a diameter less than that of the first end wall (31) faces the first driving assembly (4), and the first end wall (31) faces the fixing seat (1). Accordingly, if the bead chain disc (3) is pulled to detach from the fixing seat (1) and the first driving unit (41), the bead chain disc (3) which is pulled by the traction string (5) is inclined toward the second end wall (32) having a less diameter, so that the second end wall (32) of the bead chain disc (3) is first detached from the accommodation space (21). At the same time, the bead chain string (e) on the bead chain winding region (33) can be separated from the plurality of second gaps (321) of the second end wall (32) of the bead chain disc (3). Then, the first end wall (31) of the bead chain disc (3) is pulled out of the accommodation space (21), so that the whole bead chain disc (3) is pulled out of the accommodation space (21). Furthermore, the pulling of the traction string (5) also allows the bead chain disc (3) to be dragged by the traction string (5) to maintain a hanging state outside the accommodation space (21) without directly falling onto the ground.

What is claimed is:

1. A curtain controller structure, comprising:

a fixing seat having a first end, a second end opposite to the first end, a guiding ring radially descended from a center to a periphery at the second end thereof, and at least one long slot hole having an arc-shape and disposed on one side of the guiding ring for penetrating the first end and the second end thereof;

an assembling seat having a first end for connecting the second end of the fixing seat, a second end of the assembling seat opposite to the first end thereof, an accommodation space formed between the fixing seat and the assembling seat, a first chamber disposed at the second end of the assembling seat, and a first aperture formed on a bottom center of the first chamber for communication with the accommodation space at the first end thereof;

a bead chain disc disposed in the accommodation space and having a first end wall toward the fixing seat, a second end wall opposite to the first end wall, a center portion, and a bead chain winding region formed between an inner surface of the first end wall and an inner surface of the second end wall, a guiding recess radially protruded from a center to a periphery of an outer surface of the first end wall for connecting the guiding ring of the fixing seat for positioning, and a cone-shaped tank on an outer surface of the second end wall, wherein the first end wall has a diameter less than a diameter of the second end wall;

a first driving assembly disposed in the first chamber of the assembling seat and having a first driving unit adjacent to the second end wall of the bead chain disc, a second driving unit, and an elastic unit having a first end connected to the first driving unit and a second end connected to the second driving unit, wherein the first driving unit has a first end shaped with a cone and protruded from the first aperture on the first chamber to the accommodation space for correspondingly connecting the cone-shaped tank, and a second end opposite to the first end, the first driving unit of the first driving assembly having a first stop flange disposed between the first and second ends of the first driving unit and in contact with a bottom of the first chamber for positioning, the first end of the first driving unit protruding into the accommodation space for connecting the cone-shaped tank of the bead chain disc, a plurality of second convex ribs spaced apart from one another on a wall of the first end of the first driving unit for correspondingly contacting a plurality of first convex ribs spaced apart from one another on a wall of the cone-shaped tank for positioning, an assembling slot shaped with a polygon and disposed at the second end thereof for accommodating the elastic unit, and a first pore on a bottom of the assembling slot; wherein the second driving unit has a first end, a second end opposite to the first end, an assembling pillar shaped with a polygon and disposed at the first end of the second driving unit for correspondingly inserting into the assembling slot of the first driving unit, a receiving slot disposed at the second end of the second driving unit, and a second aperture at a bottom of the receiving slot; the elastic unit having the first end thereof for connecting the bottom of the assembling slot of the first driving unit and the second end of the elastic unit for connecting one end of the assembling pillar of the second driving unit;

a traction string having a first part for connecting the center portion of the bead chain disc and a second part opposite to the first part for connecting the first driving unit or the second driving unit of the first driving assembly, and the first part of the traction string inserts into the second aperture at the bottom of the receiving slot of the second driving unit and passes through the first pore in the assembling slot of the first driving unit to further connect a perforation on a bottom of the cone-shaped tank of the bead chain disc, and the second part of the traction string is received in the receiving slot of the second driving unit; and a bushing assembled to the second end of the assembling seat to position the first driving assembly in the first chamber of the assembling seat.

2. The curtain controller structure as claimed in claim 1, wherein the first part and the second part of the traction string are respectively formed as a retaining ring and a stop block for contacting the bottom of the receiving slot of the second driving unit for positioning, and wherein one side of the perforation at the first end wall of the bead chain disc is provided with a hook portion for hooking the retaining ring of the traction string.

3. The curtain controller structure as claimed in claim 1, wherein the first end wall has a plurality of first gaps spaced apart from one another on a periphery thereof and a plurality of first toothed parts, each formed between the two adjacent first gaps, and the second end wall has a plurality of second gaps spaced apart from one another on a periphery thereof and staggered with the plurality of first gaps and a plurality of second toothed part, each formed between the two adjacent second gaps.

4. The curtain controller structure as claimed in claim 1, wherein the bushing has a first end connected to the second end of the assembling seat for contacting a second end of a second stop flange disposed between the first end and the second end of the second driving unit for positioning, a second end opposite to the first end, a second chamber formed at a center of the second end thereof for accommodating a second driving assembly, a second through hole disposed at a bottom center of the second chamber for penetrating the first end of the bushing, and a ring gear disposed on a wall at a bottom of the second chamber; and wherein the second driving assembly has a sun gear having one end inserted into and protruded out of the second through hole at a bottom center of the second chamber of the bushing for engaging with a third toothed part disposed on a wall of the receiving slot of the second driving unit of the first driving assembly, a plurality of satellite gears for engaging with the ring gear on the wall at the bottom of the second chamber of the bushing by outer sides thereof and engaging with the sun gear by inner sides thereof, and each having an inserting hole at a center thereof, and a third driving unit having a first end provided with a plurality of pins spaced apart from one another for inserting into the inserting holes of the plurality of satellite gears and a second end opposite to the first end.

5. A curtain controller structure, comprising:

a fixing seat having a first end, a second end opposite to the first end, a guiding ring radially descended from a center to a periphery at the second end thereof, and at least one long slot hole having an arc-shape and disposed on one side of the guiding ring for penetrating the first end and the second end thereof, an assembling seat having a first end for connecting the second end of the fixing seat, a second end of the assembling seat opposite to the first end thereof, an accommodation space formed between the fixing seat and the assembling seat, a first chamber disposed at the second end of the assembling seat, and a first aperture formed on a bottom center of the first chamber for communication with the accommodation space at the first end thereof, a bead chain disc disposed in the accommodation space and having a first end wall toward the fixing seat, a second end wall opposite to the first end wall, a center portion, and a bead chain winding region formed between an inner surface of the first end wall and an inner surface of the second end wall, a guiding recess radially protruded from a center to a periphery of an outer surface of the first end wall for connecting the guiding ring of the fixing seat for positioning, and a cone-shaped tank on an outer surface of the second end wall, wherein the first end wall has a diameter less than a diameter of the second end wall;

a first driving assembly disposed in the first chamber of the assembling seat and having a first driving unit adjacent to the second end wall of the bead chain disc, a second driving unit, and an elastic unit having a first end connected to the first driving unit and a second end connected to the second driving unit, wherein the first driving unit has a first end shaped with a cone and protruded from the first aperture on the first chamber to the accommodation space for correspondingly connecting the cone-shaped tank, and a second end opposite to the first end, the first driving unit of the first driving assembly has a first stop flange disposed between the first and second ends of the first driving unit and in contact with a bottom of the first chamber for positioning, the first end of the first driving unit protruding into the accommodation space for connecting the cone-shaped tank of the bead chain disc, a plurality of second convex ribs spaced apart from one another on a wall of the first end of the first driving unit for correspondingly contacting a plurality of first convex ribs spaced apart from one another on a wall of the cone-shaped tank for positioning, an assembling slot shaped with a polygon and disposed at the second end of the first driving unit for accommodating the elastic unit, and a first pore on a bottom of the assembling slot; wherein the second driving unit has a first end, a second end opposite to the first end, an assembling pillar shaped with a polygon and disposed at the first end thereof for correspondingly inserting into the assembling slot of the first driving unit, and a receiving slot disposed at the second end of the second driving unit; the elastic unit having the first end for connecting the bottom of the assembling slot of the first driving unit and the second end of the elastic unit for connecting one end of the assembling pillar of the second driving unit;

a traction string having a first part for connecting the center portion of the bead chain disc and a second part opposite to the first part for connecting the first driving unit or the second driving unit of the first driving assembly, and the first part of the traction string passes through the first pore in the assembling slot of the first driving unit to further connect the perforation on a bottom of the cone-shaped tank of the bead chain disc and the second part of the traction string is received in the receiving slot of the second driving unit; and a bushing assembled to the second end of the assembling seat to position the first driving assembly in the first chamber of the assembling seat.

6. The curtain controller structure as claimed in claim 5, wherein the first part and the second part of the traction string are respectively formed as a retaining ring and a stop block for contacting the bottom of the assembling slot of the first driving unit for positioning, and wherein one side of the perforation at the first end wall of the bead chain disc is provided with a hook portion for hooking the retaining ring of the traction string.

* * * * *